United States Patent [19]

Dignan

[11] Patent Number: 4,714,283

[45] Date of Patent: Dec. 22, 1987

[54] CLAMPING TYPE CABINET LOCK

[75] Inventor: Donald J. Dignan, South Euclid, Ohio

[73] Assignee: The Eastern Company, Strongsville, Ohio

[21] Appl. No.: 894,378

[22] Filed: Aug. 6, 1986

Related U.S. Application Data

[63] Continuation of Ser. No. 602,173, Apr. 19, 1984, abandoned.

[51] Int. Cl.[4] ..... E05C 9/02

[52] U.S. Cl. ..... 292/48

[58] Field of Search ..... 292/113, 66, 48, 115, 292/340, 341.18, 241, 196, 223, DIG. 31, DIG. 46, DIG. 57

[56] References Cited

U.S. PATENT DOCUMENTS

| | | | |
|---|---|---|---|
| 2,669,477 | 2/1954 | Jewell | 292/341.18 |
| 2,927,812 | 3/1960 | Smith et al. | 292/196 |
| 3,873,142 | 3/1975 | Reid | 292/66 |
| 4,053,177 | 10/1977 | Stammreich et al. | 292/113 |
| 4,159,137 | 6/1979 | Richter | 292/DIG. 49 X |
| 4,554,807 | 11/1985 | Dolejs | 70/208 |

OTHER PUBLICATIONS

No. 102 Handbook of Latches, Locks, Hinges, Handles and Related Hardware, Eberhard Mfg. Co., 1983 (See particularly p. 41, Sect. 1).

*Primary Examiner*—Richard E. Moore

*Attorney, Agent, or Firm*—David A. Burge

[57] ABSTRACT

A clamping type cabinet lock that is mounted on a cabinet door includes a link-and-lever type of operating assembly which moves a vertical bar. End regions of the vertical bar are connected to pivotally mounted latch members. The latch members have latch formations that enter between and move behind keeper formations that define channels in which the latch formations are moveable. As the latch formations are moved in the keeper channels, the door is caused to be clamped toward a closed position.

14 Claims, 22 Drawing Figures

CLAMPING TYPE CABINET LOCK

This application is a continuation, of application Ser. No. 602,173, filed Apr. 19, 1984, now abandoned.

BACKGROUND OF THE INVENTION

1. Field of the Invention

The present invention relates to a heavy duty "draw" or clamping type cabinet lock for securely releasably retaining a closure such as a relatively large cabinet door in its closed position. A lock embodying the preferred practice of the invention is particularly well suited for use with a cabinet (1) that is provided with gasketing and/or shielding to minimize penetration through the juncture of its closed door and its door frame of dust, moisture and/or interfering electromagnetic radiation, and/or (2) that needs its closure securely clamped closed at one or more locations about its closure opening.

2. Prior Art

Cabinet locks are known that are designed to releasably retain a closure in its closed position, and to effect engagement with and/or compression of closure seals including gasketing and shielding. However, these prior lock proposals have inadequately addressed a number of problems.

A problem that is encountered when locks are used with enclosures that house certain types of electronic equipment is that the cabinets and their doors must cooperate to provide an adequate degree of shielding against emission and absorption of interfering electromagnetic radiation. When such cabinets have doors that are quite large, locks are needed that are capable of clamping the doors and their associated cabinets securely together at a plurality of spaced locations along the doors in order for such seals and/or shields as are provided on these structures to function properly in blocking transmission of unwanted electromagnetic radiation. When such cabinets have doors that are small, locks that snugly clamp the closures closed at single locations along each closure will frequently fulfill requirements. Prior proposals have not yielded locks that adequately address typical needs of these types that are encountered with large and small specialty electronics enclosures.

Still another problem that is encountered with electronic equipment enclosures is that the types of seals that must be employed in order to provide adequate emissions shielding tend to resist not only door closing movements but also door opening movements. Some of these seals are positioned between a closed door and its door frame, and must be compressed as the doors are closed; others are arranged to frictionally engage portions of a door or its door frame as the door is closed. In order for doors to be closed and opened easily where such seals are in use, door locks are needed that have capabilities for forcefully moving doors both into and out of their closed positions, i.e., both toward and away from their associated cabinetry.

While a wide variety of proposals have been made to provide cabinet locks with desired features, there remains a need for a clamping type cabinet lock that can be easily adapted for use in a wide variety of installations, that is capable of effecting clamping of a closure at a single location or at a plurality of spaced locations about a closure opening to securely bias a closure toward a position of engagement with an associated opening-defining frame, and that is easily adjusted not only to accommodate installation tolerances and wear, but also to provide a closing action that is characterized by a desired degree of "draw" and by a clamping action that holds the closure closed with a desired degree of forcefulness.

SUMMARY OF THE INVENTION

The present invention addresses the foregoing and other needs by providing a heavy duty "draw" or clamping type cabinet lock for securely releasably retaining a closure such as a cabinet door in a closed position relative to an opening-defining structure such as a door frame of a cabinet. The lock includes interengageable assemblies for mounting on a door and its associated door frame, including an operating unit and at least one strike unit. In preferred practice, (1) the operating unit is carried by a cabinet door and has strike-engaging formations that are carried on one or more projecting arms, and (2) one or more strike units are carried on an associated door frame, with each of the strike units defining a strike channel and being operable to receive and releasably retain in its channel such strike-engaging formations as are carried on a separate one of the projecting arms. In preferred practice the strike-engaging formations take the form of rollers that are mounted on the projecting arms, and that are releasably received between forwardly and rearwardly facing track surfaces which define the strike channels.

The operating unit preferably includes a pivotally mounted handle for positioning the projecting arm or arms. When a plurality of projecting arms are utilized, the operating unit preferably includes an operating member that moves the arms in unison.

Preferably a novel lost-motion, toggle type linkage is employed in establishing a driving connection between the handle and the arm or arms. The linkage provides a mechanical advantage to aid the operator both in opening and closing the door so that such resistance forces as may be offered to door movement by various forms of gasketing and/or emission shields can be overcome with ease. The toggle linkage permits the handle to be moved from its nested position to a position where it can be securely grasped by an operator (1) before requiring the operator to forcefully move the handle to effect roller movement, and (2) before subjecting the handle to the influence of such back pressure forces as may have been generated by the clamping action of the lock.

The handle is movable between a nested position wherein it preferably extends substantially flush with the door, and an operating position wherein the handle preferably projects forwardly from the door. When the handle is in its operating position, the linkage and the operating member cooperate with the handle to orient the arm-carried rollers in what is referred to as a "released" position for entry into and withdrawal from the strike channels. Once the rollers have entered the strike channels, pivotal movement of the handle toward its nested position will cause cooperative movements of the linkage, the operating member, and the arm-carried rollers, whereby the rollers are caused to move in unison along the strike channels from their "released" position to a "clamped" position. As the rollers so move within the strike channels, wedging actions take place that cause the door and its door frame to be drawn relatively toward each other such that the door is clamped toward the door frame at the locations of the strike units. A tool or key operated locking sub-assembly preferably forms part of the operating unit and serves to releasably secure the handle in its nested position, whereby the door may be locked in its closed position.

One feature of a lock that incorporates the preferred practice of the invention lies in the spring-biased mounting of track members that form components of the strike units. If an attempt is made to close the door while the handle is in its nested position, i.e., while the rollers are out of position for proper entry into the strike channels, the arm-carried rollers are caused to engage the spring-biased track members so that the door will not be permitted to close, but rather literally will be "bounced" toward its open position. This "bounce open" feature not only helps to assure that a full and correct closing of the door will ultimately be effected by the operator, but also serves to minimize damage to components of the lock if an incorrect closure is forcibly attempted.

A further feature lies in the versatile character of the lock design that enables accomodations to be made quite easily to provide substantially any desired positioning of the handle along the operating unit, and to utilize substantially any desired number of strike units that are located at substantially any desired arrangement of spacings along the operating unit. Since a simple dual element system comprising an elongate frame and an elongate operating member is used to mount and drivingly interconnect the roller-carrying arms of the operating unit, substantially any desired number of these arms can be incorporated in an operating unit at substantially any desired spacing.

Still another feature of the preferred practice lies in the provision of adjustable elements on the operating unit and the strike unit that enable adjustments to be made with ease to accomodate installation tollerances and wear, and to provide the lock with a clamping action that is characterized by desired degrees of "draw" as well as desired degrees of forcefulness.

From an aesthetic point of view, a lock embodying the preferred practice of the present invention does nothing to distract from the appearance of a specialty enclosure on which it is installed. Indeed, despite the fact that the lock includes an extensive, rugged operating mechanism which may well extend along a majority of the length of a door on which it is mounted, all that needs to be exposed for ready access from the exterior of the enclosure are the front faces of the lock's operating handle and the locking sub-assembly that serves to releasably retain the handle in its nested position. A relatively small rectangular opening formed through the front face of a door is typically all that is needed to render these components accessible.

BRIEF DESCRIPTION OF THE DRAWINGS

The foregoing and other features and advantages, and a fuller understanding of the invention may be had by referring to the following description and claims, taken in conjunction with the accompanying drawings, wherein:

DESCRIPTION OF THE PREFERRED EMBODIMENT

Figure 1:
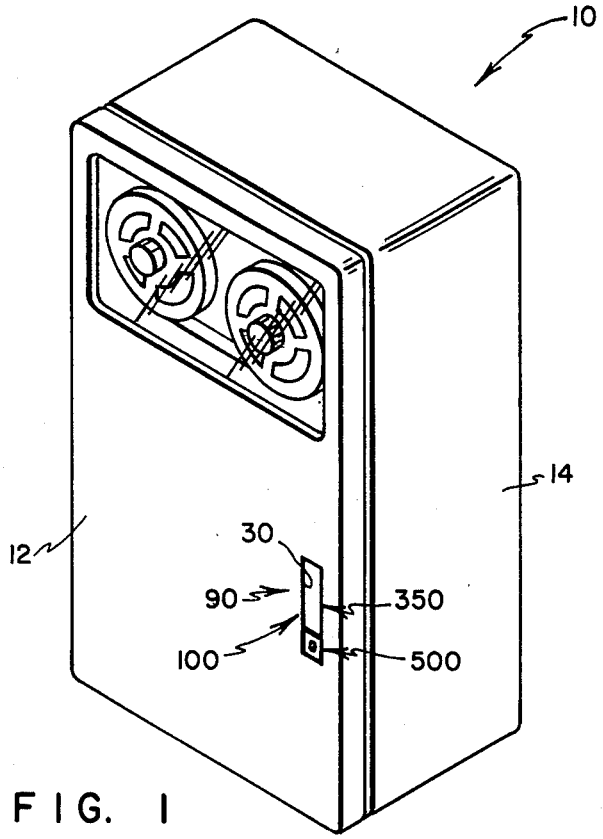
FIG. 1 is a perspective view of an electronic equipment enclosure including an open front cabinet having a hinged door and employing one form of a lock that embodies the preferred practice of the present invention for releasably maintaining the door in its closed position.
Figure 2:
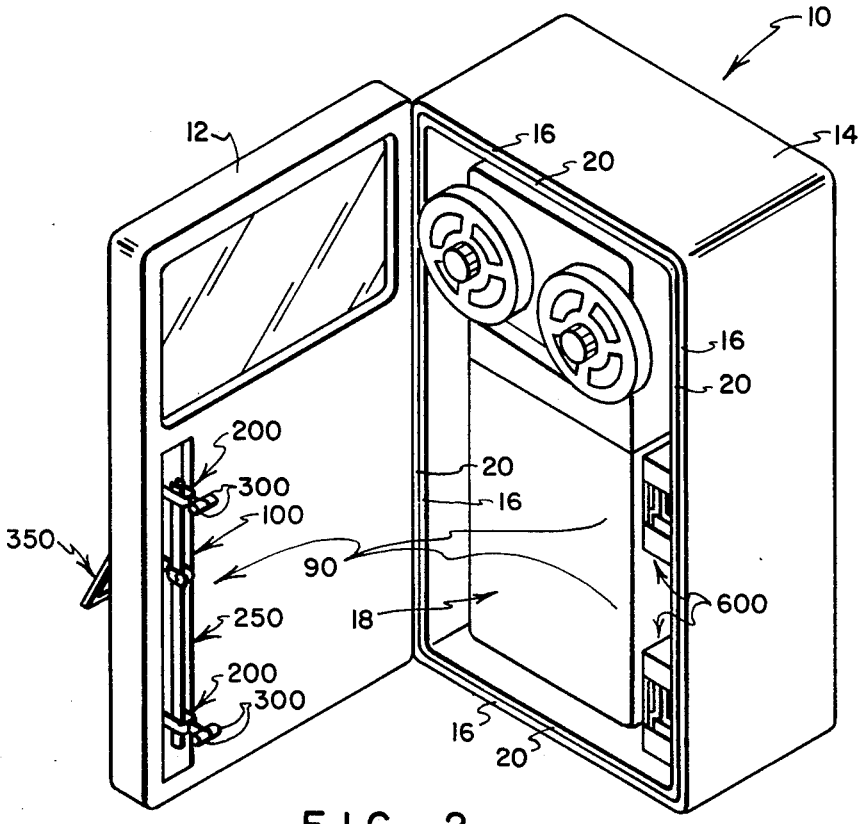
FIG. 2 is a perspective view similar to FIG. 1 but with the door in its open position, showing the lock's operating unit as mounted on the door, and the lock's strike units as mounted on the cabinet.

Referring to FIGS. 1 and 2, an enclosure for electronic equipment is indicated generally by the numeral 10. The enclosure 10 includes a door 12 and a cabinet 14. The door is pivotally connected to the cabinet 14 by suitable hinges (not shown) for movement between a closed position shown in FIG. 1, and an open position shown in FIG. 2.

Referring to FIG. 2, the cabinet 14 has an opening-defining portion or door frame 16 that defines a forwardly-facing opening 18. When the door 12 is in its closed position, the door 12 is positioned closely alongside the door frame 16 and closes the opening 18.

A seal 20 is carried on the door frame 16 of the cabinet 14 for sealingly engaging the door 12 when the door 12 is closed. While the seal 20 is depicted as comprising a ribbon of resilient gasket material of the type that is intended to be compressed between the door 12 and the door frame 16 when the door 12 is closed, those skilled in the art will understand that more elaborate commercially available seals and/or shields may be employed in conjunction with or in substitution for the seal 20 to minimize migration and/or transmission through the juncture of the closed door 12 and the cabinet 14 of dust, moisture, interfering electromagnetic radiation and the like. While such seals and/or shields as may be selected for use with the door 12 and the cabinet 14 have nothing to do with the preferred practice of the present invention, locks that embody the present invention are sufficiently versatile to accommodate the use of almost any desired type of seal, and to provide a means for closing and opening the door 12 even if a selected seal and/or shield is of the type that provides a forceful "drag" on the door 12 that inhibits both closing and opening movements of the door 12.

Figure 3:
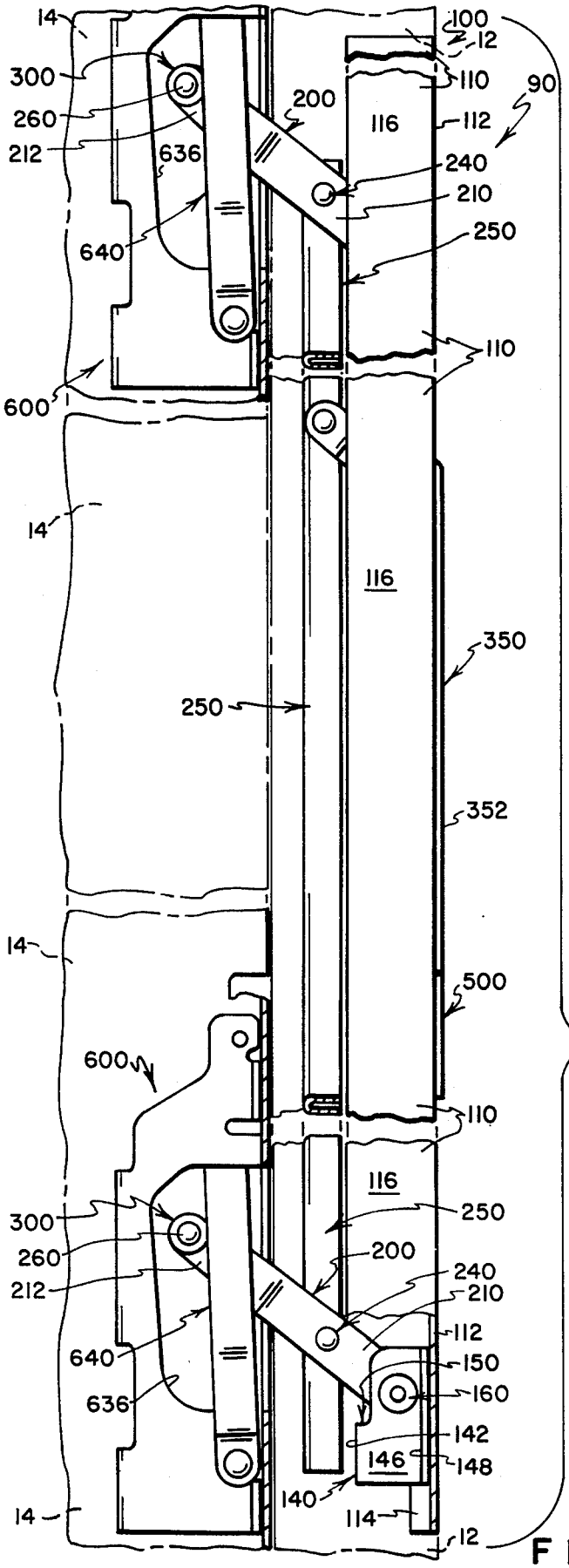
FIG. 3 is a foreshortened side elevational view, on an enlarged scale, of the lock as utilized in the enclosure of FIG. 1, with portions of the frames of the strike unit broken away and shown in cross section, and with portions of the enclosure being depicted in phantom.

Referring to FIGS. 1-3, a clamping type lock embodying one form of preferred practice of the present invention is indicated generally by the numeral 90. The lock 90 is arranged to releasably retain the door 12 in its closed position. The lock 90 includes a door-carried operating unit that is indicated generally by the numeral 100, and a plurality of cabinet-carried strike units 600 that are indicated generally by the numeral 600. Referring to FIG. 1, the door-carried operating unit 100 includes a handle 350 and a handle locking sub-assembly 500 which project through a generally rectangular opening 30 that is formed in the front face of the door 12. From an aesthetic point of view, a feature of the lock 90 lies in the fact that, despite the extensive nature of the lock's operating mechanism and its rugged, heavy duty construction, the only elements of the lock 90 that need be exposed to view through the enclosure 10 are the components 350, 500, which project through the rectangular hole 30 formed in the door 12.

Before turning to a detailed description of the various components of the operating unit 100, an overview of the components of the operating unit 100 will be presented.

Figure 4:
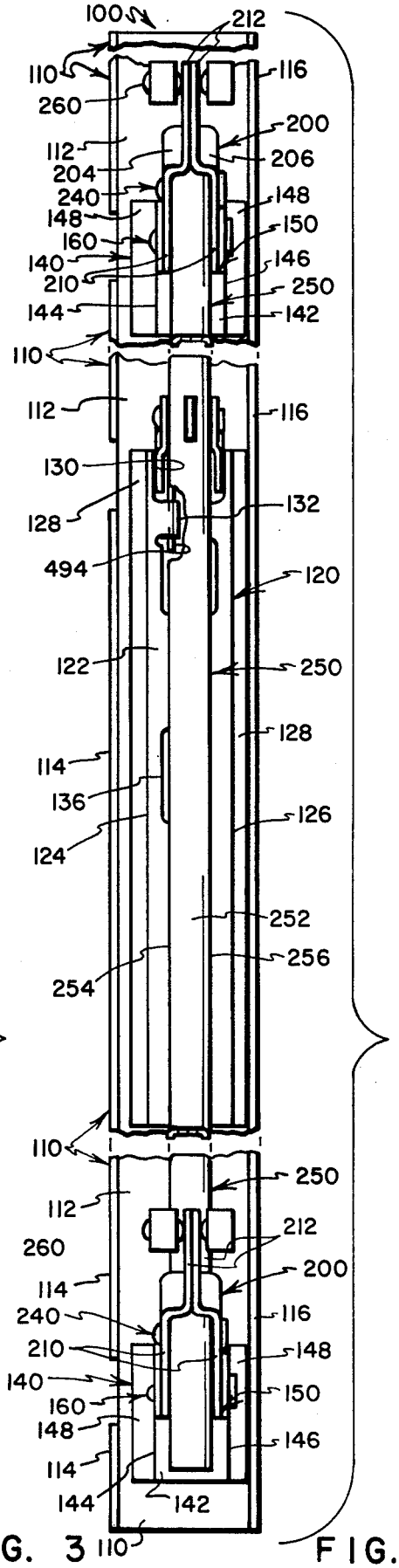
FIG. 4 is a foreshortened rear elevational view of the lock's operating unit.

Referring to FIGS. 3 and 4, the door-carried operating unit 100 includes an elongate frame 110 that pivotally mounts the handle 350 and a plurality of projecting arms 200. In the lock embodiment 90 of FIGS. 1-13, only two projecting arms 200 are employed. The handle 350 is movable between a "nested" position shown in FIGS. 1, 3, 4 and 6-10, and an "operating" position shown in FIGS. 2, 5 and 12. The projecting arms 200 are movable between a "released" position shown in FIGS. 2 and 5, and a "clamped" position shown in FIGS. 3 and 4. An elongate operating member 250 drivingly interconnects the projecting arms 200. The operating member 250, the frame 110 and the arms 200 cooperate to define a parallelogram linkage which assures that the arms 200 will pivot in unison relative to the frame 110.

Figure 5:
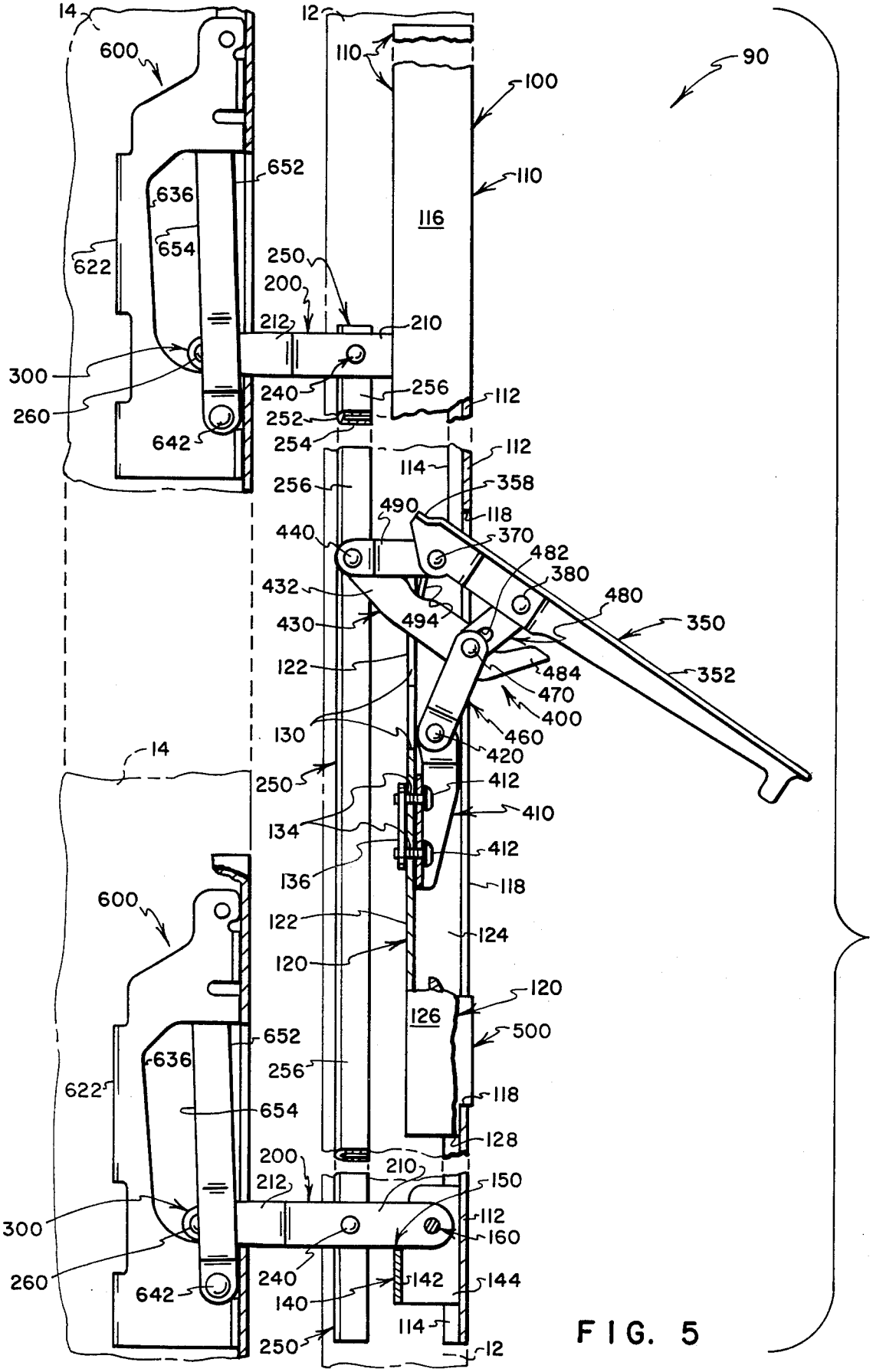
FIG. 5 is a foreshortened side elevational view similar to FIG. 3, but with components of the lock oriented in a released position that permits the door to be opened, and with portions of the frame of the operating unit broken away and shown in cross section.

Referring to FIG. 5, a lost-motion, toggle type linkage 400 drivingly interconnects the handle 350 and the operating member 250 for moving the operating member 250 to position the projecting arms 200 in response to movement of the handle 350. The locking sub-assembly 500 is carried by the frame 110 to releasably retain the handle 350 in its nested position.

The operating unit 100 also includes a plurality of strike engaging formations that take the form of rollers 300. The rollers 300 are mounted on the projecting arms 200. When the arms 200 are in their released position shown in FIGS. 2 and 5, the rollers 300 are oriented for entry into or withdrawal from channels 650 that are defined by the strike units 600. Once the rollers 300 have entered the strike channels 650, pivotal movement of the handle 350 will cause pivotal movement of the arms 200 to effect movement of the rollers 300 toward their clamped position shown in FIGS. 3 and 4. The rollers 300 are retained in their clamped position by the locking sub-assembly 500 which engages the handle 350 to releasably retain the handle 350 in its nested position. As will be explained in greater detail, the strike channels 650 are oriented such that, as the rollers 300 move along the channels 650 toward their clamped position, a wedging action takes place which causes the door 12 to be clamped toward a position of engagement with the door frame 16 of the cabinet 14.

Turning now to a more detailed description of the operating unit 100, the frame 110 is preferably formed as an elongate stamping from a sheet of steel. Referring to FIGS. 3-5, the frame 110 has a generally U-shaped cross-section, as defined by a front wall 112 and a pair of side walls 114, 116 that extend rearwardly from opposite sides of the front wall 112. A generally rectangular opening 118 is formed through the front wall 112.

Figure 7:
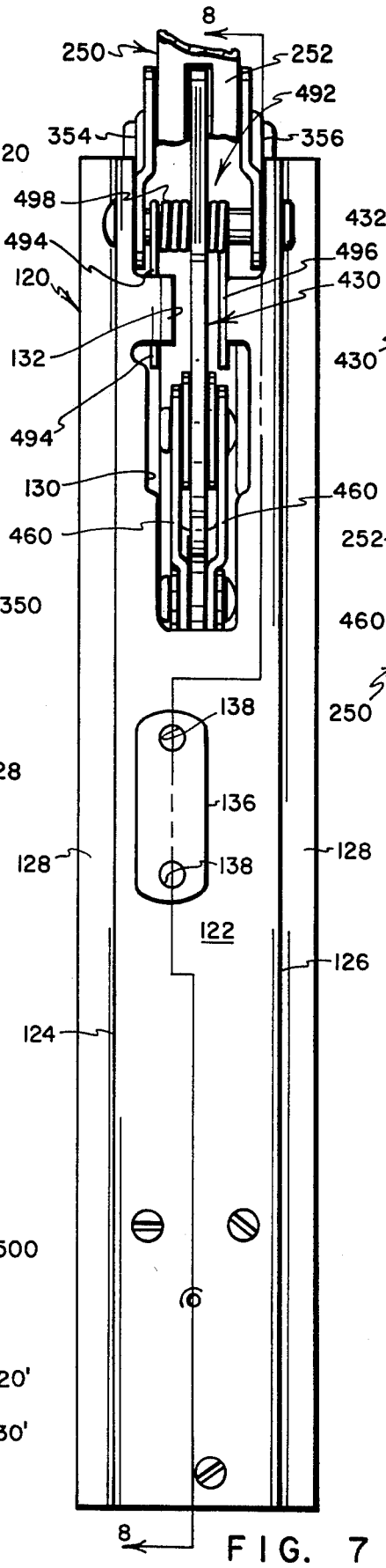
FIG. 7 is a rear elevational view thereof.
Figure 8:
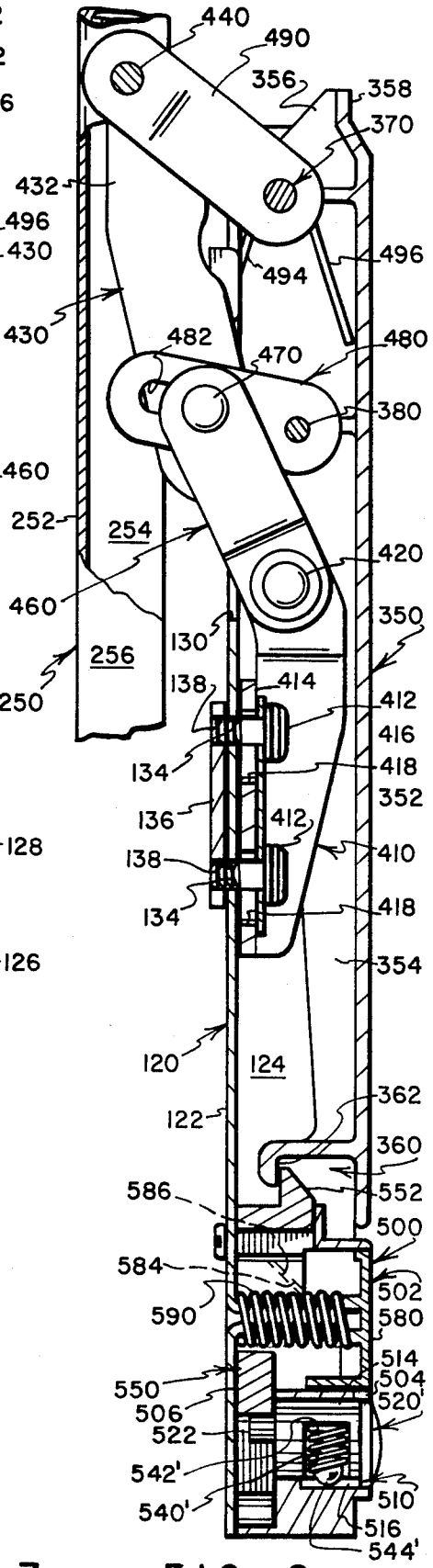
FIG. 8 is a sectional view thereof as seen from planes indicated by a broken line and by arrows 8—8 in FIG. 7.

An elongate housing 120 is welded to the rear face of the front wall 112 and overlies the region of the rectangular opening 118. The housing 120 has a back wall 122, a pair of forwardly extending side walls 124, 126, and a pair of mounting flanges 128 that are secured to the rear face of the front wall 112, preferably by welding. An elongate slot 130 is formed in the upper end region of the back wall 122. Referring to FIGS. 4 and 7, a tab-like portion of the back wall 122 projects into the slot 130 and defines a spring engaging formation 132. Referring to FIGS. 3 and 8, a pair of holes 134 are formed through the back wall 122. A weld nut 136 that defines a pair of threaded passages 138 which align with the holes 134 is welded to the rear side of the back wall 122.

Referring to FIGS. 3-5, a pair of brackets 140 are welded to the rear face of the front wall 112 near opposed end regions thereof. The brackets 140 are of generally U-shaped cross-section as defined by a back wall 142, a pair of opposed side walls 144, 146 that extend forwardly from the back wall 142, and a pair of mounting flanges 148 that engage the rear surface of the front wall 112 and are secured thereto, preferably by welding. The back wall 142 does not join the opposed side walls 144, 146 along their entire lengths, but rather defines a stop surface 150 that extends between the side walls at position about midway along the lengths of the side walls 144, 146. Aligned holes (not shown) are formed through the side walls 144, 146 to receive rivets 160. The rivets 160 pivotally mount the projecting arms 200 on the brackets 140 for pivotal movement relative to the frame 110. The stop surfaces serve to engage the arms 200 when the arms 200 are in their released position.

The projecting arms 200 are identical one with another. Referring to FIG. 4, each of the arms 200 is formed as a welded assembly of a pair of doglegged plates 204, 206. Referring to FIGS. 3 and 4, the plates 204, 206 have forwardly extending portions 210 that are spaced apart and extend substantially parallel to each other, and rearwardly-extending portions 212 that are welded together. A first set of aligned holes (not shown) are formed through the forwardly-extending portions 210 to receive rivets 160, whereby the arms 200 are pivotally connected to the brackets 140. A second set of aligned holes (not shown) are formed through the plates 204, 206 at positions about midway along the lengths of the arms 200 to receive rivets 240 that connect the arms 200 to the operating member 250. A third set of aligned holes (not shown) are formed through the rearwardly-extending portions 212 to receive rivets 260 that mount the rollers 300 on the arms 200.

The projecting arms 200 are drivingly interconnected by the operating member 250 and are caused to move in unison as the operating member 250 is moved relatively to the frame 110 in directions that extend longitudinally along the frame 110, whereby the rollers 300 are caused to pivot in unison about the axes along with their associated arms 200 that are connected to the frame 110 by the rivets 160.

The rollers 300 are preferably formed from a wear resistant plastics material, e.g., Nylon. The rollers 300 are journaled by the rivets 260 such that the rollers 300 are free to rotate relative to the arms 200.

Figure 6:
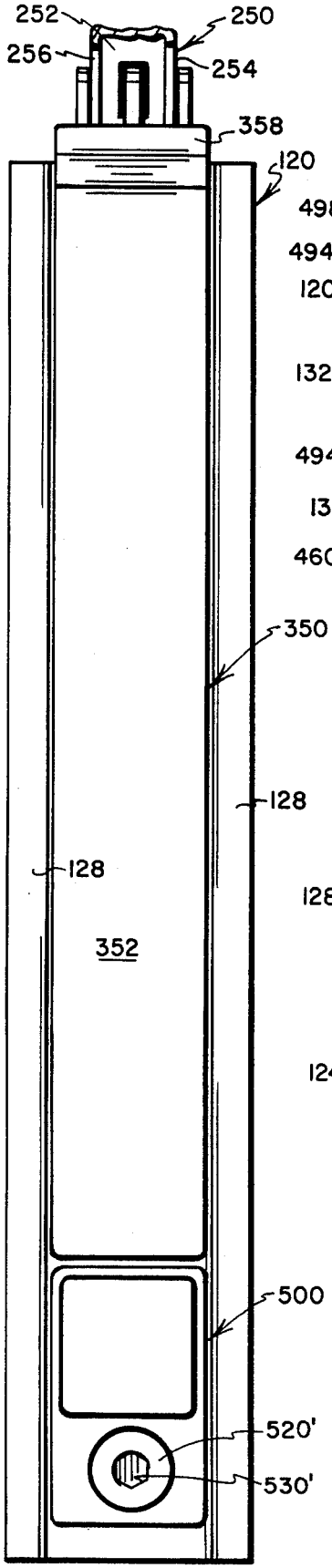
FIG. 6 is a front elevational view, on an enlarged scale, of portions of a handle assembly that is employed in the operating unit.

Referring to FIGS. 6–8, the handle 350 is preferably formed from die cast metal, and has a flat front wall 352 that is of generally rectangular configuration. The handle 350 has a pair of rearwardly extending side walls 354, 356. The handle 350 has a recessed tip portion 358 on its upper end region, and a bolt receiving recess 360 formed in its lower end region. The recess 360 is defined in part by a downwardly extending shoulder 362 that is engaged by a slide bolt 550 which forms a part of the locking sub-assembly 500, as will be explained. A pair of mounting holes (not shown) are formed through the upper portion of the handle 350 to receive rivets 370, 380. The rivet 370 extends through aligned holes (not shown) that are formed through the side walls 124, 126 of the housing 120 to establish a fixed pivot axis for the handle 350 and to pivotally mount the handle 350 on the housing 120. The rivet 380 extends through a hole that is formed through one end of a slotted operating link 480 that forms part of the lost-motion, over center handle linkage 400.

The lost-motion, over center handle linkage 400 provides a very simple mechanism for achieving several significant objectives. The linkage 400 is adjustable to aid the lock 90 in accomodating installation tollerances and in providing a clamping action that is characterized by desired degrees of "draw" and clamping forcefulness. The linkage 400 permits an operator to move the handle 350 from its nested position to a position illustrated in FIG. 11 wherein the handle 350 can be securely grasped before the handle 350 becomes subjected to such forces as are being carried by toggle links 430, 460 of the linkage 400. The links 430, 460 perform a "toggle" function, move "over center," and are caused to execute their "toggle" and "over center" movements in response to applications of force from the operating link 480 which is slotted as at 482 to provide for a "loss of motion" in transmitting movement to the toggle links 430, 460 from the handle 350, hence the reasons why the linkage 400 is referred to as a "lost-motion, over-center toggle linkage."

Referring to FIGS. 5 and 8–13, the linkage 400 includes a mounting link 410 that is rigidly (but adjustably) secured to the housing 120 by threaded fasteners 412. As is best seen in FIG. 8, the mounting link 410 has a base portion 414 that extends along the back wall 122 of the housing 120, and a forwardly extending portion 416 that resides between the side walls 124, 126 of the housing. Elongate slots 418 are formed through the base portion 414. The fasteners 412 extend through the slots 418 and through the back wall holes 134 into the threaded holes 138 that are provided by the double weld nut 136. The fasteners 42 are securely tightened in place so that the mounting link 410 normally does not move with respect to the housing 120, but may be loosened so that the link 410 can be adjusted by moving it longitudinally with respect to the housing 120 as is permitted by the lengths of the elongate slots 418. A hole is formed through the forwardly extending portion 416 of the link 418 to receive a rivet 420.

Toggle links 430 and 460 interconnect the mounting link 410 and the operating member 250. The toggle link 430 has an end region 432 that carries a rivet 440 which extends through aligned holes that are formed through the side walls 254, 256 of the operating member 250 to pivotally connect the toggle link 430 to the operating member 250. A rivet 470 extends through aligned holes formed through the toggle link 430 and through the one end region of each of the side-by-side toggle links 460 to pivotally interconnect the toggle links 430, 460. The other end regions of the side-by-side toggle links 460 have aligned holes that receive the rivet 420 to pivotally connect the toggle links 460 to the mounting link 410.

Figure 12:
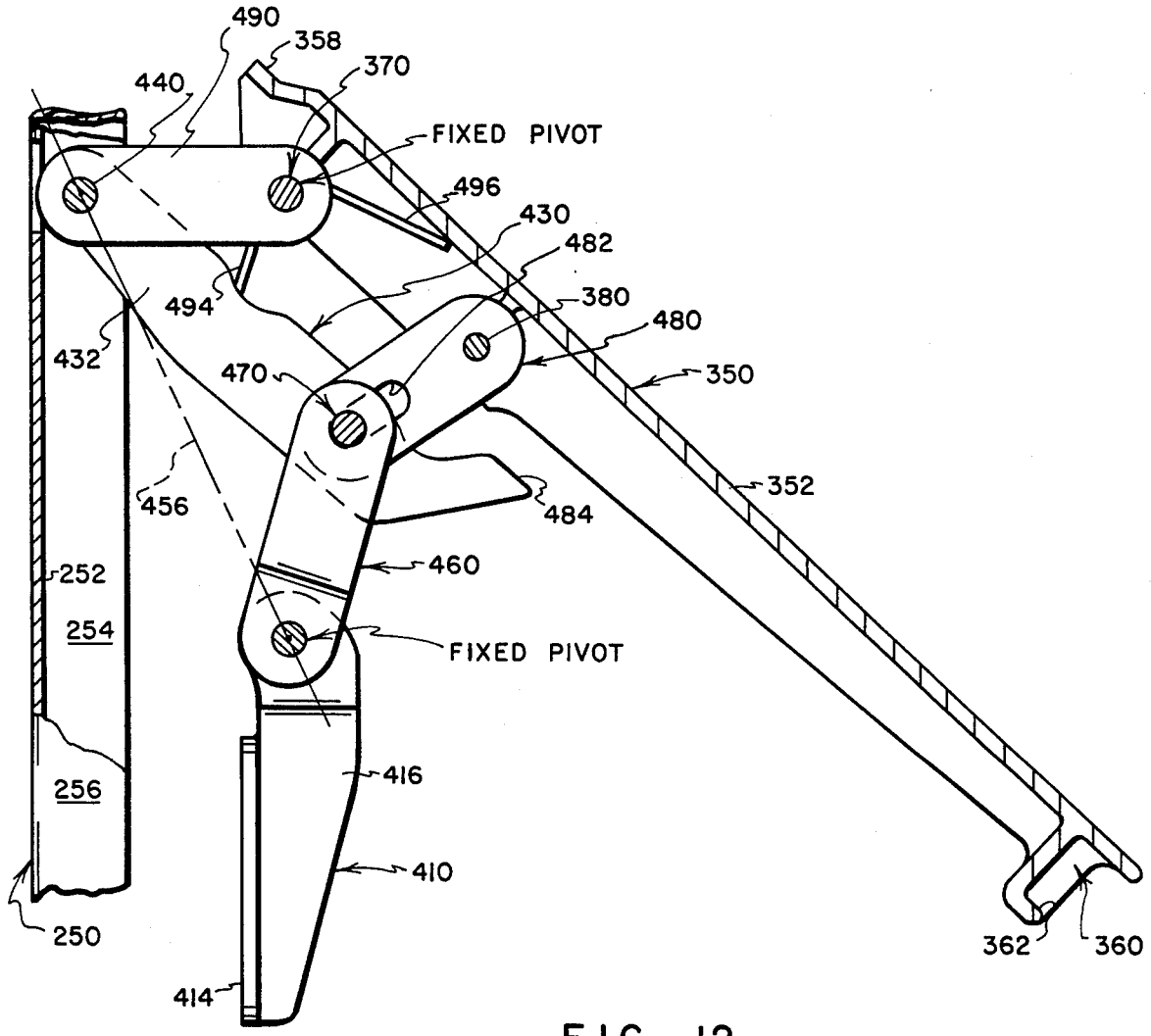
FIG. 12 is a side elevational view similar to FIGS. 10 and 11, but with the handle fully projected, i.e., in its operating position.
Figure 13:
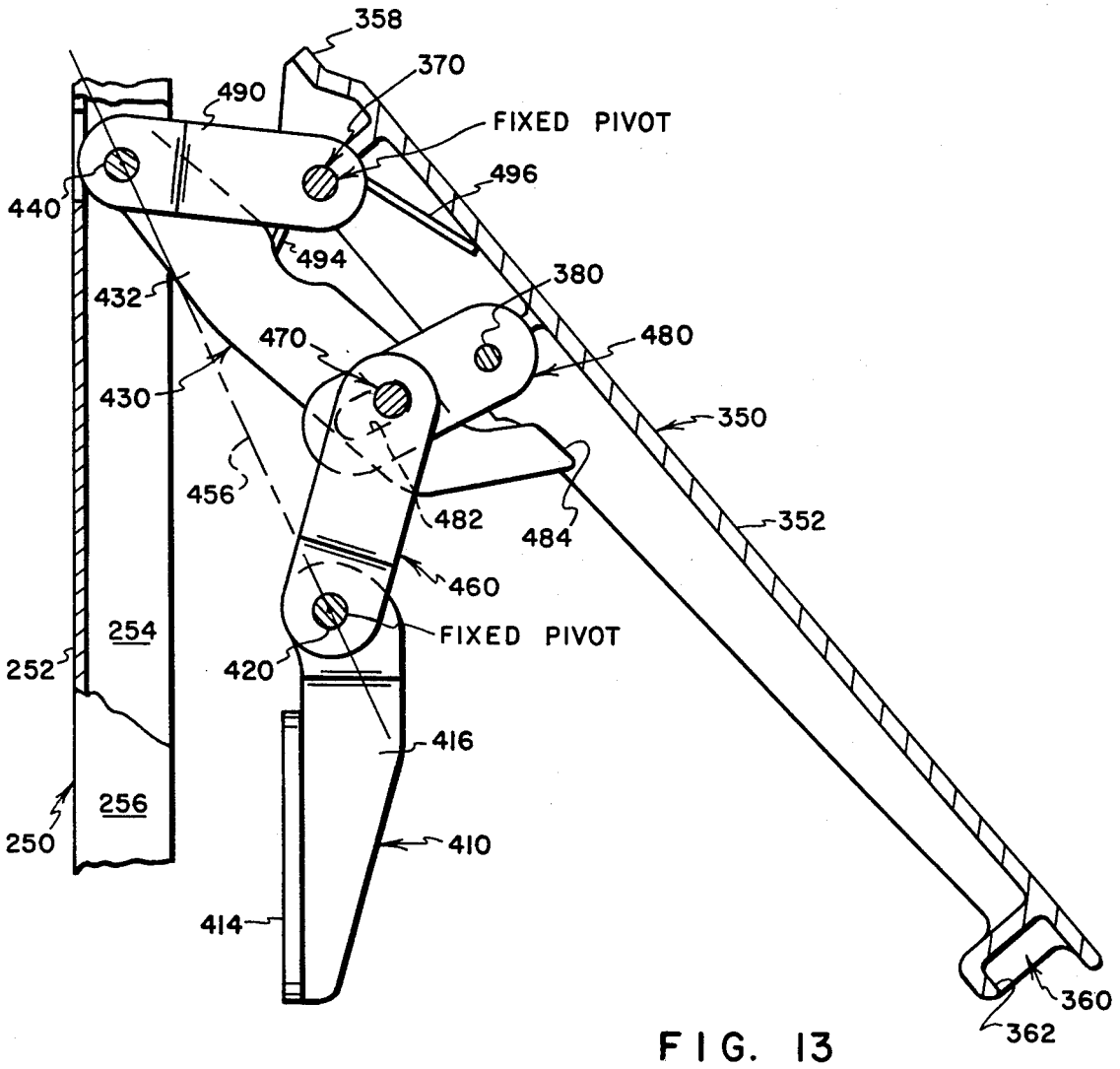
FIG. 13 is a side elevational view similar to FIG. 11, but with the handle less than fully projected, which view, when compared with FIG. 10, illustrates the range of lost motion movement that is provided by a slotted link in the handle linkage.

A slotted operating link 480 has a hole formed through one of its end regions to receive the handle-carried rivet 380, whereby the operating link 480 is pivotally connected to the operating handle 350. An elongate slot 482 is formed in the operating link 480 to receive the toggle link interconnecting rivet 470 to provide a "lost motion" connection between the handle 350 and the toggle links 430, 460. By this arrangement, the handle 350 can move relative to the toggle links 430, 460 without causing corresponding movement of the toggle links 430, 460, and visa versa. Such movement of the handle 350 relative to the toggle links 430, 460 without causing corresponding movement of the toggle links 430, 460 is illustrated in the drawings, e.g., a comparison of the positions of the handle 350 in FIG. 12 with the position of the handle 350 in FIG. 13 shows that the handle 350 has moved while the toggle links 430, 460 have remained stationary; likewise, a comparison of the positions of the handle 350 and the toggle links 430, 460 in FIGS. 10 and 11 shows the same type of "lost motion" movement has taken place by virtue of the engagement of the rivet 470 with opposed ends of the elongate slot 482 of the operating link 480.

Figure 10:
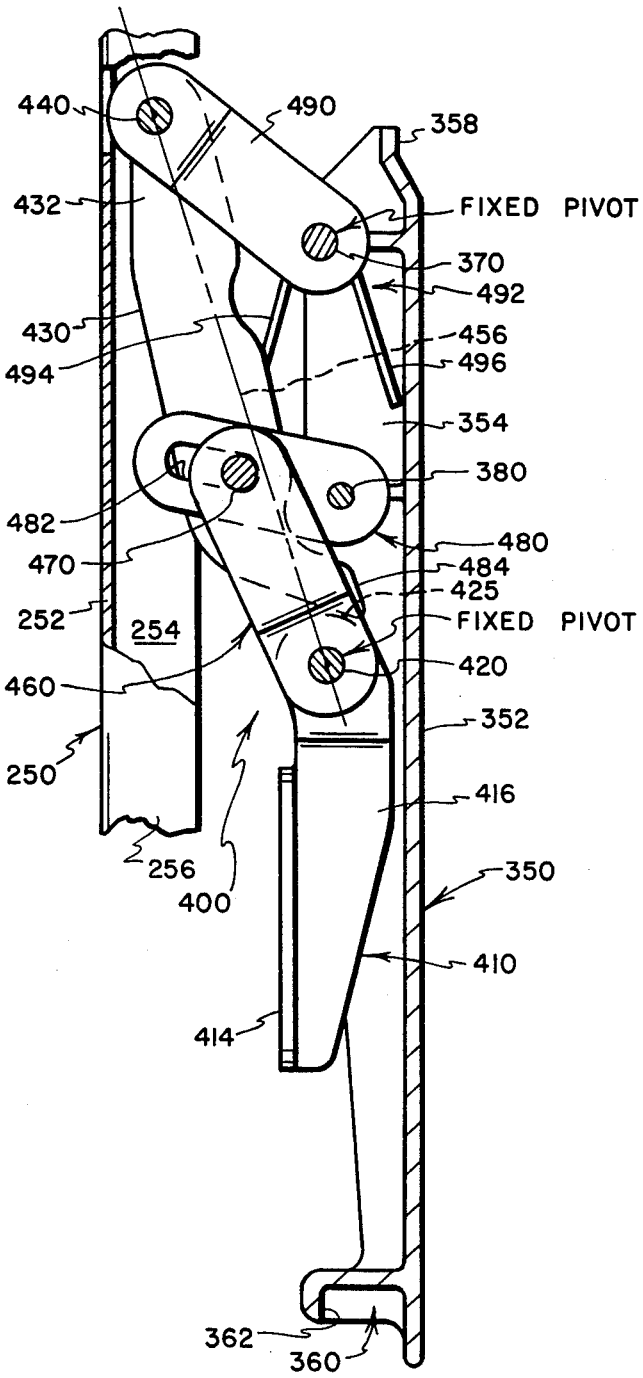
FIG. 10 is a side elevational view thereof, with portions broken away and shown in cross section, and with the handle shown in its nested position.
Figure 11:
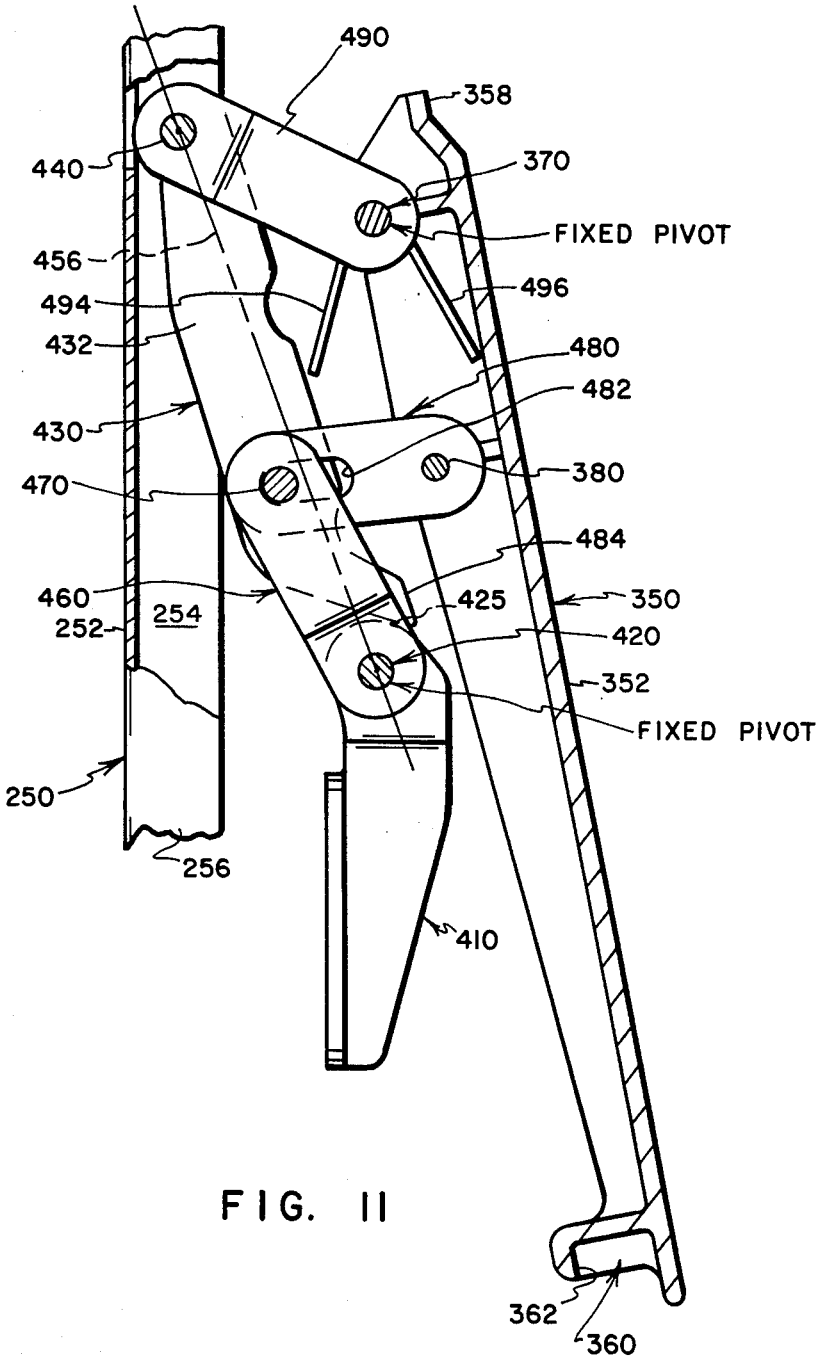
FIG. 11 is a side elevational view similar to FIG. 9, but with the handle projected to a position that is intermediate its nested and operating positions, which view, when compared with FIG. 10, illustrates the range of lost motion movement that is provided by a slotted link in the handle linkage.

Referring to FIG. 10, the toggle link 430 has a nose formation 484 that is configured to engage the forwardly projecting portion 416 of the mounting link 410 when the toggle links 430, 460 are in the "over center" positions of the FIGS. 10 and 11. The point of engagement of the links 430, 410 is designated by the numeral 425 in FIGS. 10 and 11. This engagement limits the "over center" travel of the toggle links 430, 460. The type of "over center" movement that is executed by the links 430, 460 is best understood by observing the alignment of the rivets 440, 420 which engage the distal ends of the links 430, 460, in comparison with the position of the rivet 470 that interconnects the links 430, 460. In FIGS. 10 and 11 a line 456 interconnects the centers of the rivets 440, 420, whereby it is readily apparent that the location of the link interconnecting rivet 470 is to the rear (to the left as viewed in FIGS. 10 and 11) of the line 456. In FIGS. 12 and 13, however, the location of the link interconnecting rivet 470 is seen to lie forward (to the right as viewed in FIGS. 12 and 13) of the line 456 which interconnects the centers of the rivets 440, 420. The type of movement that has been executed by the toggle links 430, 460 in moving from the positions illustrated in FIGS. 10 and 11 wherein the location of the rivet 470 is on one side of a line interconnecting the centers of the rivets 440, 420, to the positions illustrated in FIGS. 12 and 13 wherein the location of the rivet 470 is on the other side of the line 456, is called an "over center" movement in that the location of the rivet 470 moves over the center line 456 that interconnects the centers of the rivets 440, 420.

The consequence of this "over center" movement is quite significant. When the toggle links 430, 460 are positioned as shown in FIGS. 10 and 12 such that the rivet 470 lies rearwardly of the center connecting line 456, the clamping and back pressure forces that are transmitted from the door 12 to the cabinet 14 (i.e., from the door 12 to the frame 110 to the housing 120, through the mounting link 410 and through the rivet 420 to the interconnected toggle links 430, 460 to the rivet 440 and to the operating member 250 for transmission to the arms 200 and thence through the rollers 300 to the strike units 600 and to the cabinet 14) tend to "collapse" or "fold" the toggle links 430, 460 in a rearward direction of travel such that these forces are not transmitted through the operating link 480 to the handle 350. Thus, when the toggle links 430, 460 are positioned as is illustrated in FIGS. 5 and 8, the handle 350 is relieved from the influence of such forces as may be imposed on the toggle links 430, 460, whereby the handle 350 can be moved freely between the nested position illustrated in FIGS. 8 and 10 and, the readily graspable position illustrated in FIG. 11. Continued forward movement of the handle 350 (starting with the lock components positioned as illustrated in FIG. 11) will cause the operating link 480 to pull the toggle links 430, 460 "over center," whereupon the influence of such forces as are being transmitted through the toggle links 430, 460 between the door 12 and the cabinet 14 will be imposed on the operating link 480 and will be transmitted to the handle 350. The advantage of this arrangement is that the handle 350 can be moved freely out of its nested position to the position illustrated in FIG. 11 where the handle 350 can be securely grasped by an operator before the handle 350 is subjected to the influence of such forces as may be loading the toggle links 430, 460, whereby the operator can be assured of having good control over the handle 350 at a time when the handle 350 is subjected to the influence of such forces as are being carried by the toggle links 430, 460. Such forces as are transferred to the handle 350 tend to be diminished as they are relieved by the "lost motion" movement capability that is provided by the slotted operating link 480.

Figure 17:
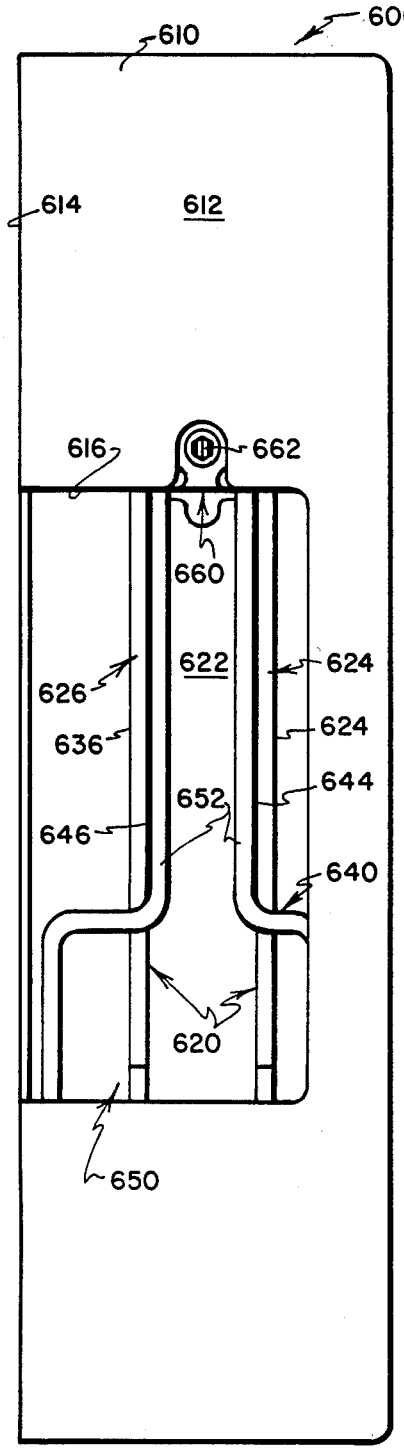
FIG. 17 is a front elevational view, on an enlarged scale, of a strike unit that embodies features of the present invention.

A similar advantage is provided by the over center toggle linkage 400 when the handle 350 is moved from its fully extended or "operating" position as shown in FIG. 17 toward its nested position shown in FIG. 5. Preliminary rearward movement of the handle 350 is a "lost motion" type of movement due to the slotted character of the operating link 480, as will be apparent from comparing the positions of the handle 350 in FIGS. 12 and 13; in FIG. 13 the handle 350 has pivoted rearwardly relative to the position that is assumed by the handle 350 in FIG. 12 (leftwardly as viewed in these Figures), but no corresponding movement of the toggle links 430, 460 has taken place. As the handle 350 continues to be pivoted rearwardly, the operating link 480 drivingly engages the rivet 470, whereupon the influence of such forces as are transmitted between the door 12 and the cabinet 14 through the toggle links 430, 460 is felt by an operator as he forcefully moves the handle 350 toward its nested position. As the handle 350 closely approaches its nested position, a rearward "over center" movement of the toggle links 430, 460 takes place, whereupon the links 430, 460 pivot rearwardly, thereby relieving the handle 350 from the influence of such forces as are being transmitted through the links 430, 460.

Figure 21:
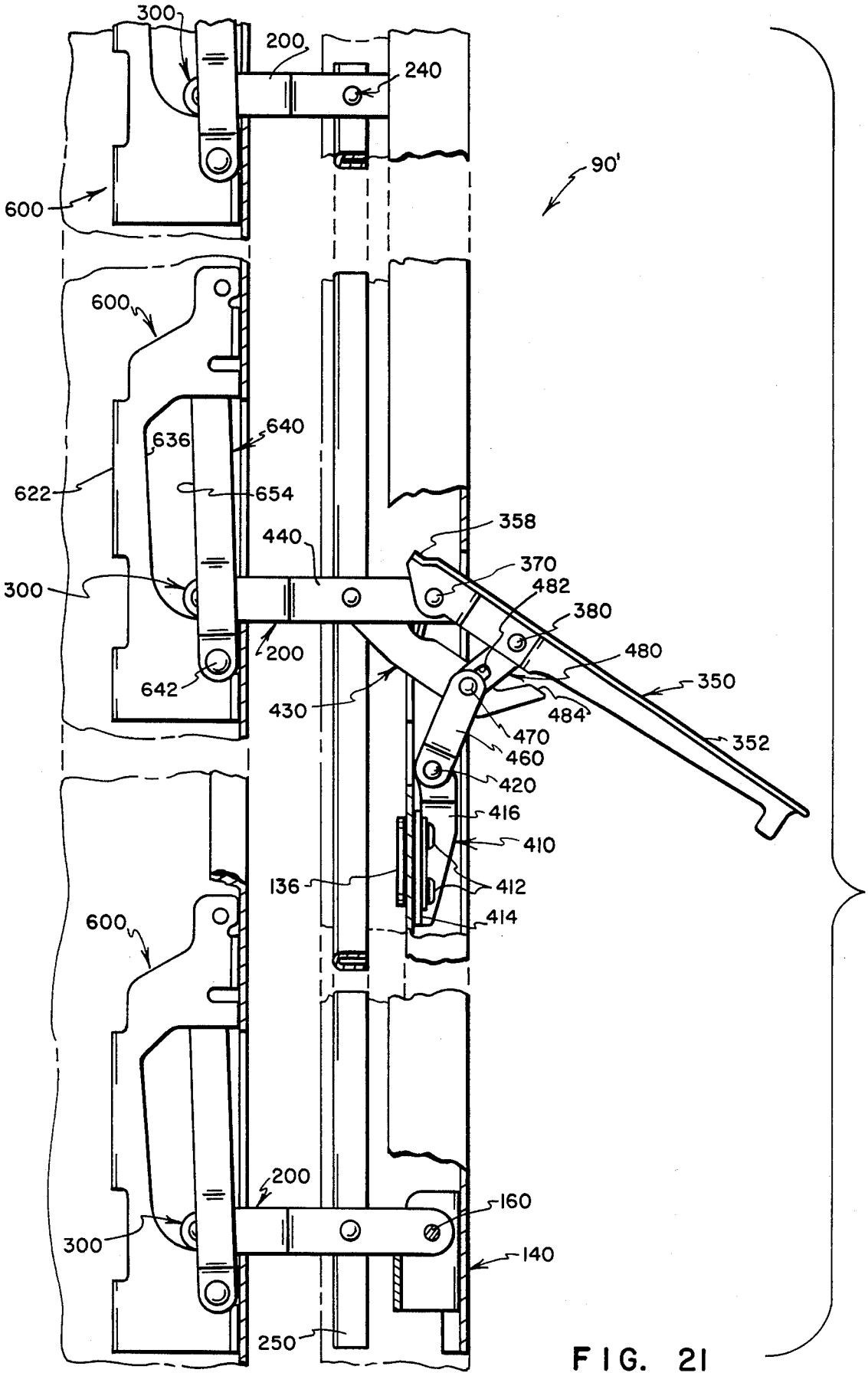
FIG. 21 is a foreshortened side elevational view similar to FIG. 5 of an alternate form of lock embodying the preferred practice of the present invention, wherein a total of three projecting arms are employed to position rollers in engagement with a total of three strike units; and, FIG. 22 is a foreshortened side elevational view similar to FIG. 5 of still another alternate form of lock embodying the preferred practice of the present invention, wherein a single projecting arm is employed to position rollers in engagement with a single strike unit.
Figure 22:
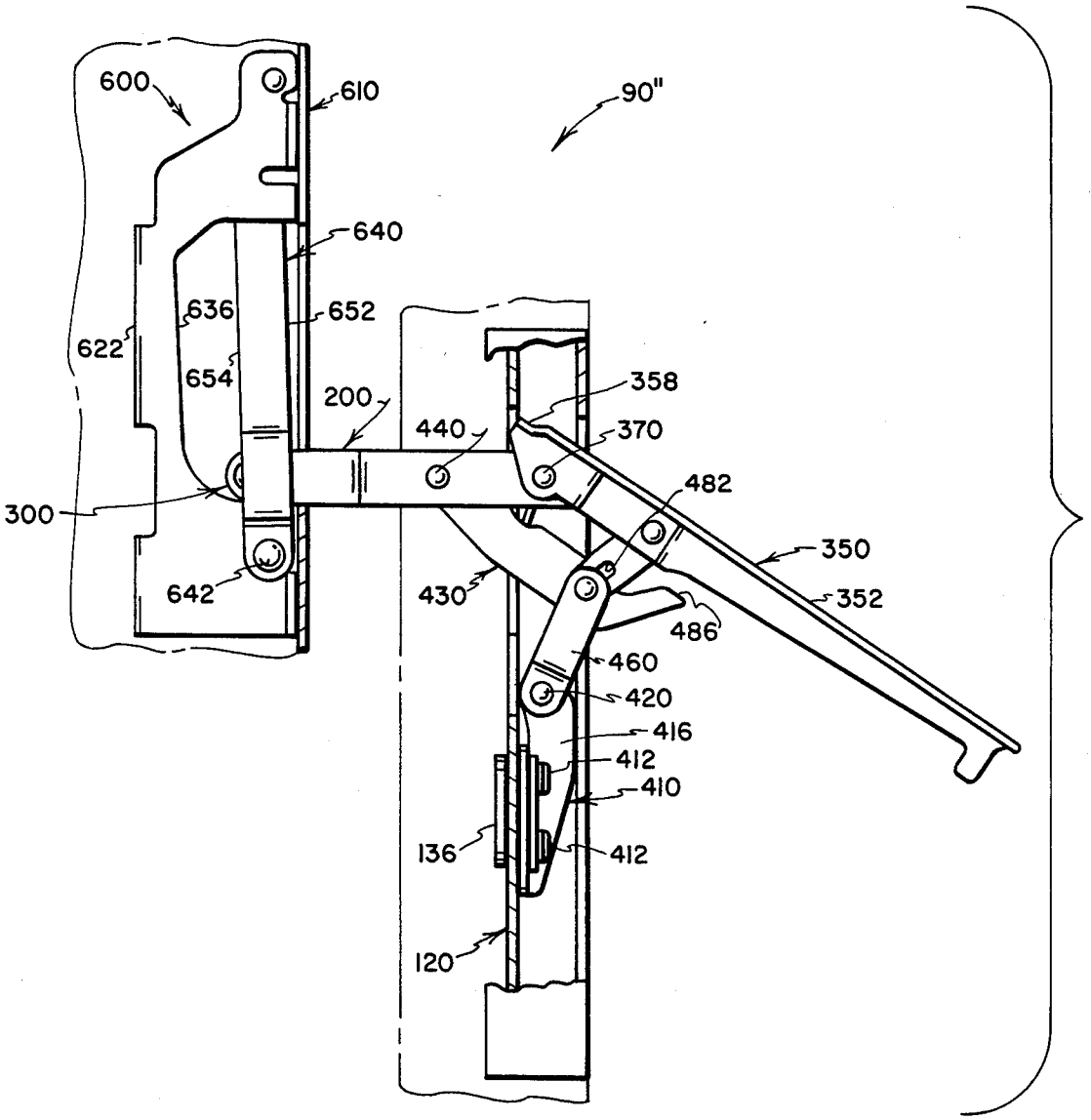

In the lock embodiment 90, a pair of idler links 490 are provided to interconnect the rivets 370, 440 to help assure that proper spacing is maintained between the handle 350 and the operating member 250. In an alternate lock embodiment 90' shown in FIG. 21, a projecting arm 200 that carries rollers 300 is substituted for the idler links 490, and a third strike unit 600 is provided to receive the rollers 300 of the third projecting arm 200. In still another alternate embodiment 90" shown in FIG. 22, a single projecting arm 200 is directly operated in the manner of the added arm 200 in the embodiment 90' of FIG. 21. The embodiment 90" employs no operating member 250 since there is no plurality of arms 200 to be interconnected for coordinated movement. As those skilled in the art will readily understand, the lock embodiments 90' and 90" differ from the embodiment 90 substantially only in the provision these embodiments make for the use of a greater or a lesser number of strike units 600, rollers 300, and projecting arms 200 than are used by the embodiment 90.

Figure 9:
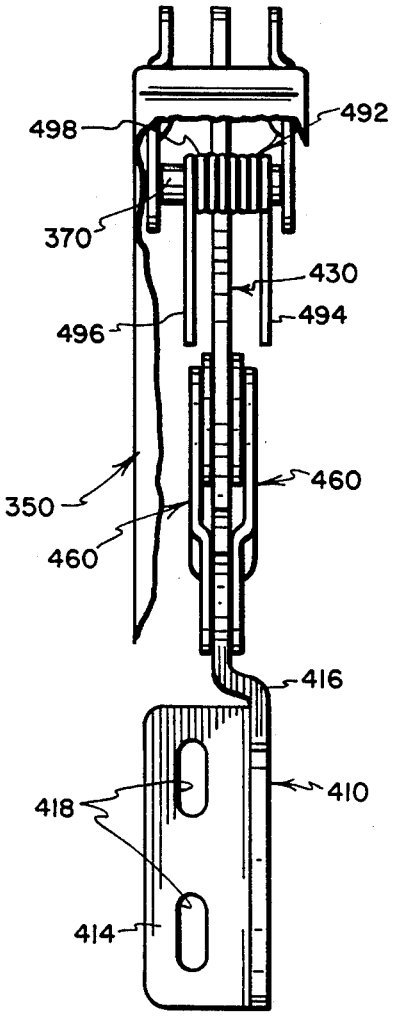
FIG. 9 is a front elevational view of selected parts of the handle assembly, with portions of the handle broken away to permit elements of an underlying lost-motion, toggle type handle linkage to be viewed.

Referring to FIGS. 9 and 10, a torsion coil spring 492 has opposed end regions 494, 496, and a center portion 498 that encircles the rivet 370. One of the opposed end regions 494 engages the spring receiving formation 132 of the back wall 122 of the housing 120, as has been described. The other end region 496 of the spring 492 engages the back face of the front wall 352 of the handle 350. The spring 492 serves to bias the handle 350 away from its nested position so that, when the locking subassembly 500 releases its engagement with the nested handle 350, the handle 350 will pivot forwardly under the influence of the spring 492 to the position illustrated in FIG. 11.

Referring to FIGS. 8 and 14–16, the locking subassembly 500 includes a body 502 that is preferably formed from die cast metal. The body 502 has a generally flat front wall 504, and a back wall 506. A lock cylinder receiving passage 510 is formed through the body 502 and opens through the front and back walls 504, 506. The passage 510 is formed by a hole 512 that has a pair of grooves 514, 516 (see FIG. 8) that extend along its opposed sides. One of the grooves 514 extends the full length of the hole 512, i.e. the groove 514 opens through the front wall 504 and through the back wall 506. The other of the grooves 516 opens through the front wall 504 but extends along the hole 512 only to a position near (but not opening through) the back wall 506. A lock cylinder 520 is positioned in the passage 510. The lock cylinder 520 is of generally cylindrical configuration, except for a rearwardly ard radially projecting formation 522 that extends beyond the back wall 506. In order to insert the cylinder 520 into the passage 510, the projecting formation 522 is aligned with the groove 514 so that the cylinder 520 can be slided into place in the passage 510, whereafter the lock cylinder 520 is rotated with respect to the body 502 about the axis of the hole 512 to move the projecting formation 522 out of alignment with the groove 514. The projecting formation 522 cooperates with the back wall 506 to retain the cylinder 520 in place in the passage 510.

Figures 14, 15, 16:
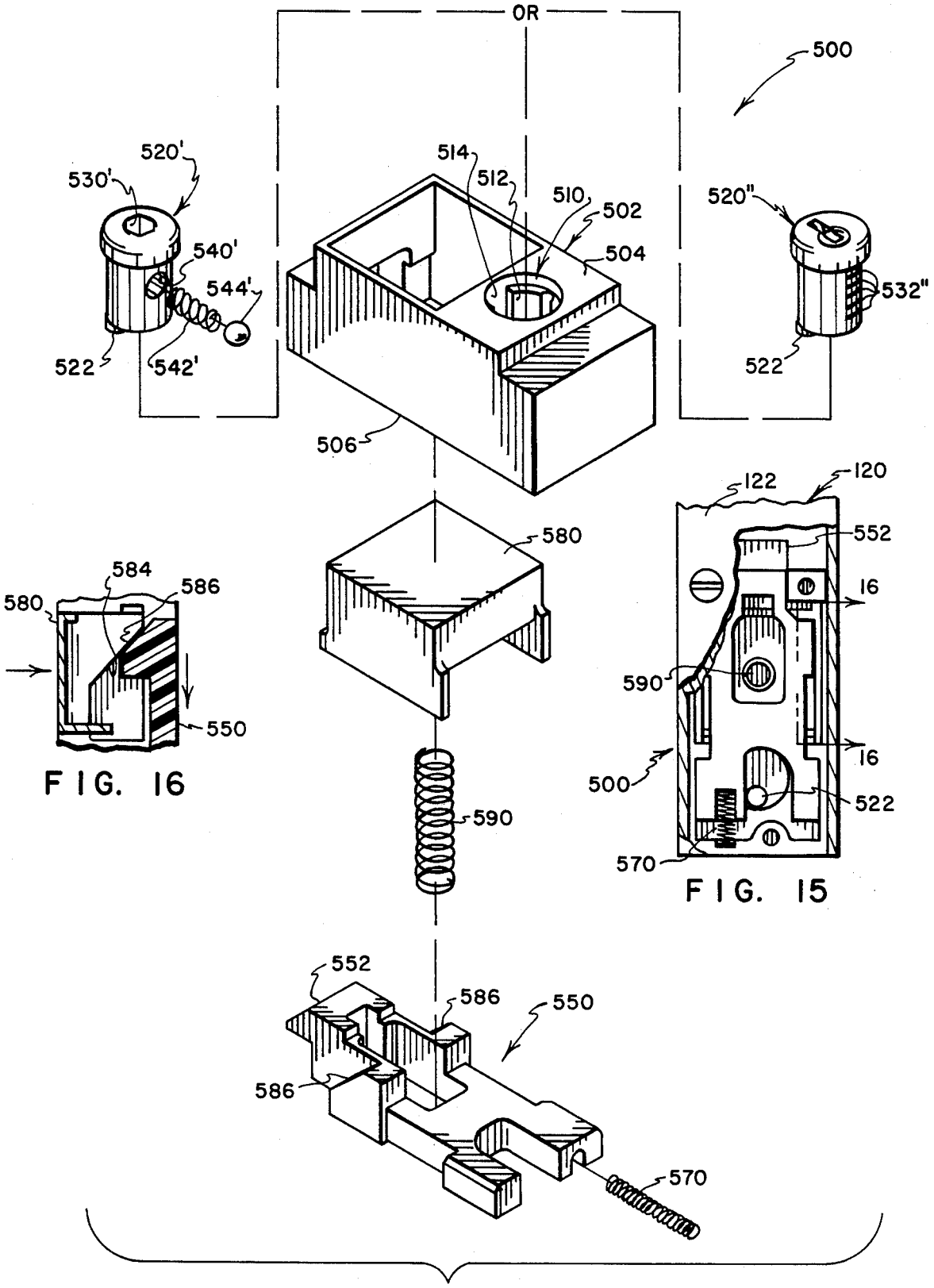
FIG. 14 is an exploded perspective view of components of a locking sub-assembly that forms a part of the operating unit, with both tool-operated and key-operated lock cylinders being shown, either of which may be employed with the remaining components of the sub-assembly.
FIG. 15 is a rear elevational view of portions of the operating unit, with portions broken away to enable elements of the locking sub-assembly to be seen.
FIG. 16 is a sectional view thereof as seen from a plane indicated by arrows 16—16 in FIG. 15.

The lock cylinder 520 can, as is depicted in FIGS. 8 and 14, comprise a tool-operated plug 520' that has a tool-receiving formation 530' in its forwardly-facing end, or can comprise a standard key operated lock cylinder 520" of the type shown in FIG. 14 that has tumblers 532" which project from one or both of its opposed sides when an appropriately configured key (not shown) is absent from the cylinder 520". Regardless of whether a tool-operated plug 520 or a key-operated lock cylinder 520" is used, the purpose of these members is to provide a means for moving the projecting formation 522 between a locked position shown in FIG. 8, and an unlocked position shown in FIG. 15. Where the cylinder is a tool-operated plug 520', a hole 540' is preferably formed in the side of the cylinder 520', and a compression coil spring 542' followed by a hardened steel ball 544' are inserted into the hole 540' to provide a spring projected detent that is engageable with either of the grooves 514, 516 to selectively retain the cylinder 520' in its locked and unlocked positions.

A slide bolt 550 is carried by the housing 120 for movement between a latched position shown in FIGS. 8 and 15, and an unlatched position (not shown) wherein a tapered projecting end 552 of the bolt 550 is withdrawn from extending into the handle passage 360. A compression coil spring 570 is interposed between the body 502 and the slide bolt 550 to bias the slide bolt 550 toward its projected, latched position.

A push-button 580 is slidably carried in a passage 582 that extends through the body 502. The push-button 580 is movable between a normally projected position shown in FIGS. 8 and 16, and a depressed, operating position (not shown) wherein interacting cam surfaces 584, 586 which are formed on the button 580 and on the slide bolt 550 cooperate to cause the slide bolt 550 to retract from its projected position in response to depression of the button 580 from its normal projected position into the passage 582. A compression coil spring 590 is interposed between the back wall 122 of the housing 120 and the button 580 for biasing the button 580 toward its normally projected position.

The locking sub-assembly 500 is operable, when the lock cylinder 520 is positioned in its unlocked position, to permit the button 580 to be depressed to effect retracting movement of the slide bolt 550, whereby the tapered end region 552 of the slide bolt 550 will no longer overlie the latching formation 362 of the handle 350, and the handle 350 will therefore be permitted to pivot forwardly under the influence of the torsion spring 490 to the intermediate position shown in FIG. 11. When the handle 350 is in its nested position, and when the lock cylinder 520 is operable to position the projecting formation 522 in its locked position, the projecting formation 522 engages the slide bolt 550 and prevents its being retracted by depression of the button 580, whereby the slide bolt 550 retains the handle 350 in its nested position despite efforts an operator may make to release the handle 350 by trying to depress the button 580.

Figure 18:
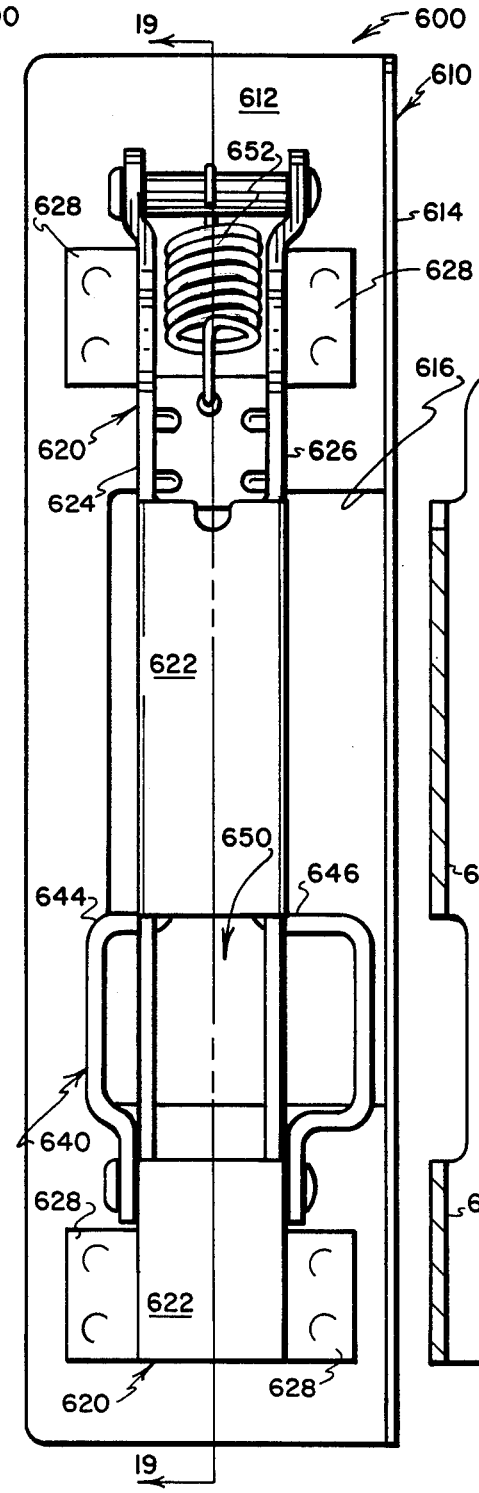
FIG. 18 is a rear elevational view thereof.
Figure 19:
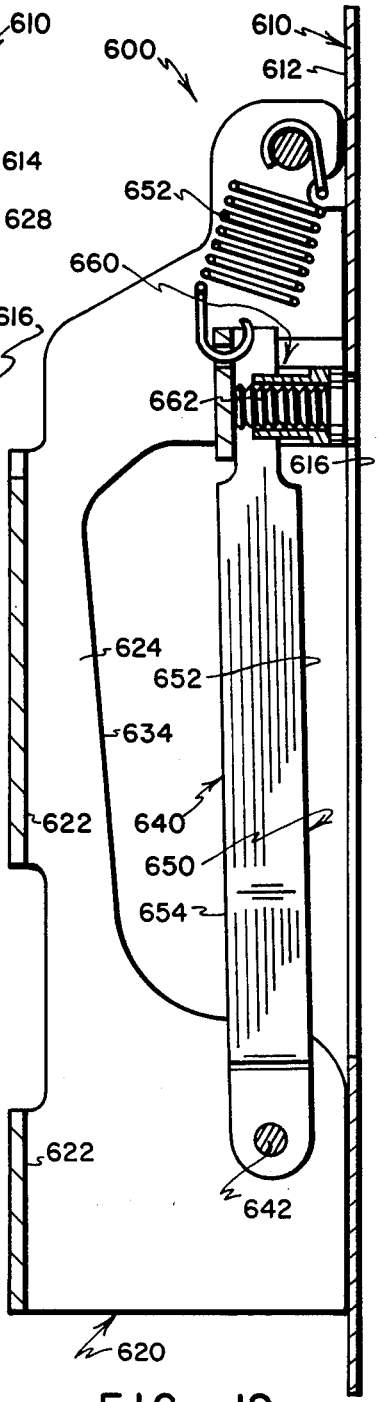
FIG. 19 is a sectional view as seen from a plane indicated by arrows 19—19 in FIG. 18.

Referring to FIGS. 17–19, the strike units 600 each include a frame 610 that has a front wall 612 and one rearwardly extending side wall 614. A generally rectangular opening 616 is formed through the front wall 612. A bracket 620 is welded to the back face of the front wall 612. The bracket has a back wall 622 and a pair of forwardly extending side wall members 624, 626 that have integrally formed mounting flanges 628. The flanges 628 extend along and are welded to the front wall 612.

Figure 20:
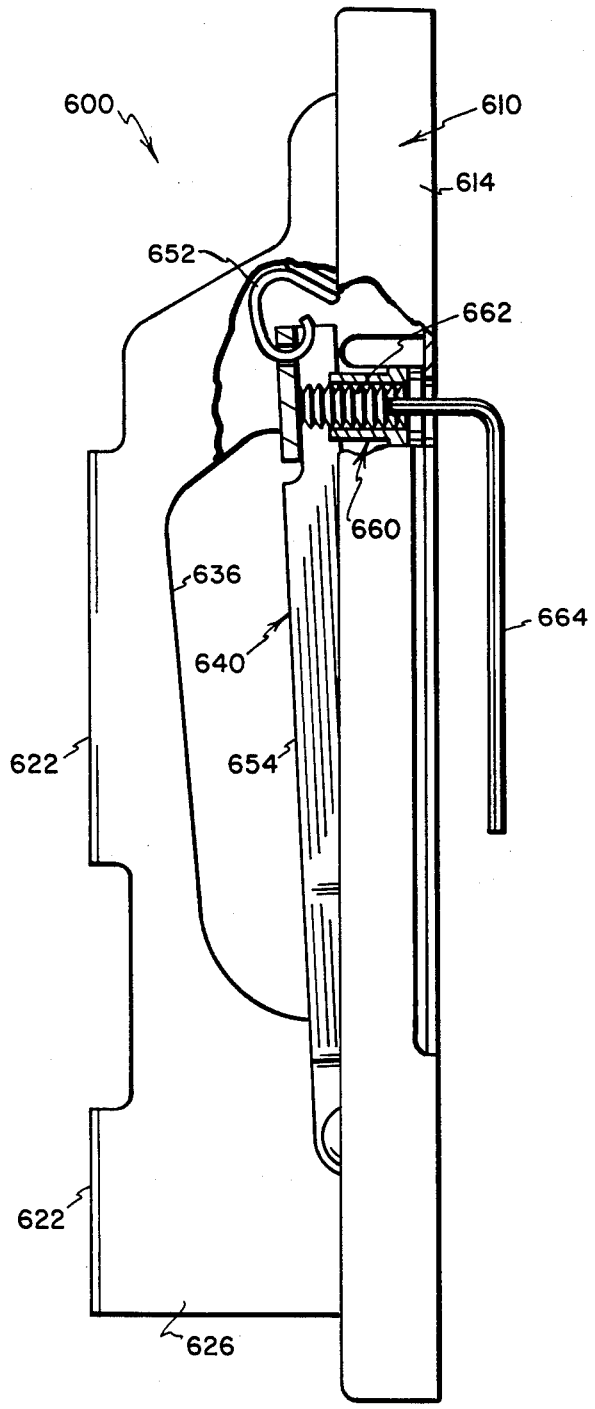
FIG. 20 is a side elevational view thereof, with portions broken away and shown in cross section, illustrating how the strike unit may be adjusted.

The side wall members 624, 626 define curved, forwardly facing track surfaces 634, 636. A track member 640 has a pair of arms 644, 646 that extend across the rectangular front wall opening 616. The arms cooperate to define an entry passage 650 for the arm-carried rollers 30, and to define forwardly facing abutment surfaces 652, and rearwardly facing track surfaces 654. The lower end region of the track member 640 is pivotally connected to the side wall members 624, 626 by a rivet 642. A tension spring 652 biases the upper end region of the track member 640 toward a position of engagement with a stop assembly 660. The stop assembly 660 includes a set screw 662 that is adjustable, as is best seen in FIG. 20, using an Allen wrench 664 to control the angle of inclination of the rearwardly facing track surfaces 654.

The spring biased mounting of the track member 640 serves the function of preventing damage from occurring to the rollers 300 if an attempt is made to close the door 12 when the handle 350 is in its nested position (or when the rollers 300 are not otherwise aligned for passage through the entry passage 650).

The strike units 600 function in three ways to engage the arm-carried rollers 300. A first manner of interaction between the arm-carried rollers 300 and the strike units 600 comes as the result of the spring-biased mounting of the track members 640 on the frames 610 of the strike units 600. Should an attempt be made to engage the rollers 300 with the strike units 600 when the rollers 300 are not properly aligned for entry through the strike channel entry passages 650, the rollers will engage the forwardly-facing surfaces 634, 636 of the track members 640, and will cause the track members 640 to be pivoted rearwardly in opposition to the springs 652. As the springs 652 cushion the movement of the door 12, the springs 652 return the track members 640 to their normal positions wherein they engage the stop assemblies 660, which movement biases the door 12 toward its open position with the biasing action being of a resilient, bounce-like nature that literally "bounces" the door 12 open.

A second type of interaction that occurs between the arm-carried rollers 300 and the strike units 600 takes place when the rollers 300 are inserted through the strike channel entry passages, and the operating handle 350 is then moved toward its nested position to move the rollers 300 along the rearwardly-facing track surfaces 654 that are defined by the track members 640. As the rollers 300 move in the strike channels along the rearwardly-facing track surfaces 640, the pivoting of the arms 200 about their axes of pivotal connection with the operating unit's frame 110 causes the rollers 300 to be clamped securely into engagement with the rearwardly-facing track surfaces 640, whereby the door 12 is drawn toward, i.e., clamped toward, the door frame 16 of the cabinet 14. Stated in another way, as the rollers 300 move along the strike channels, a wedging action takes place that causes the toggle links 430, 460 to be subjected to clamping forces that remain in operation while the door 12 is held in its closed position.

A third type of interaction that occurs between the arm-carried rollers 300 and the strike units 600 takes place when the handle 350 is operated to open the door 12. When the handle 350 is raised toward its fully projected operating position, the rollers 300 are moved into engagement with the forwardly-facing track surfaces 634, 636 that are defined by the side wall members 624, 626 of the strike units 600, whereby the curved track surfaces 634, 636 cause the rollers 300 to execute a downwardly and forwardly oriented movement that forces the door 12 toward its open position and thereby aids in overcoming any resistance to door movement that may be provided by such gasketing or shielding as may be utilized about the door frame 16.

As should be apparent from the foregoing description, the lock of the present invention provides a means for securely releasably retaining a closure 12 in securely clamped relationship with an associated opening-defining structure 16. The types of interaction that are provided between the operating unit 100 and the strike units 600 aids in moving the door 12 both toward and away from its closed position. Locks embodying described features of the preferred practice of the present invention are particularly suited for use with electronic equipment enclosures where snug clamping of relatively movable closure and cabinet parts are needed to prevent unwanted transmission and absorption of electomagnetic wave interference.

Although the invention has been described in its preferred form with a certain degree of particularity, it is understood that the present disclosure of the preferred form has been made only by way of example and numerous changes in the details of construction and the combination and arrangement of parts may be resorted to without departing from the spirit and scope of the invention as hereinafter claimed. It is intended that the patent shall cover, by suitable expression in the appended cliams, whatever features of patentable novelty exist in the invention disclosed.

What is claimed is:

1. A lock for releasably retaining a movable closure member such as cabinet door in a closed position with respect to an opening-defining structure such as a door frame, wherein the lock comprises:

(a) elongated operating unit means including first frame means for mounting on a selected one of a pair of relatively movable members such as a cabinet door and its associated door frame, with the first frame means having opposed forward and rearward sides thereof;

(b) at least one strike unit means including second frame means for mounting on the other of the relatively movable members;

(c) the strike unit means including strike channel means connected to the second frame means for defining an elongate strike channel, including elongate track means extending longitudinally along one side of the elongate strike channel for defining a pair of elongate, longitudinally extending, laterally spaced strike channel track surfaces, with the strike channel being bounded along at least portions of said one side by the pair of elongate, longitudinally extending, laterally spaced strike channel track surfaces;

(d) the operating unit means having components which are movable relative to the first frame means including:

(i) handle means pivotally connected to the first frame means for movement relative to the first frame means between a nested position defined within the first frame means, and an operating position projecting from the forward side of the first frame means;

(ii) arm means pivotally connected to the first frame means and disposed on the rearward side of the first frame means for movement relative to the first frame means between released and clamped positions;

(iii) strike-engaging means carried on the arm means for engaging the strike channel track surfaces and for being guided by the strike channel track surface for movement longitudinally along the strike channel and for being releasably retained therein by the engagement between the strike-engaging means and the strike channel track surfaces;

(iv) operating means for drivingly interconnecting the handle means and the arm means for concurrent pivotal movement relative to the first frame means such that, when the handle means is moved to its operating position from its nested position, the arm means is caused to move from its clamped position to its released position whereby the strike-engaging means is moved within the strike channel to a position wherein it can be inserted into and removed from the strike channel, and when the handle means is moved to its nested position from its operating position at a time when the strike-engaging means is received within the strike channel, the arm means is caused to move from its released position to its clamped position whereby the strike-engaging means is caused to move along the strike channel to a position wherein the strike- engaging means is retained within the strike channel by the engagement of the strike-engaging means with the track surfaces; and, (v) latch means connected to the first frame means and having movable formation means for releasably engaging and selectively retaining the operating handle in its nested position.

2. The lock of claim 1 wherein the track means of the strike unit means further includes:

(a) means defining an entry opening into the elongate strike channel, with the entry opening being configured to receive the strike-engaging means to permit the strike-engaging means to move into and out of the strike channel when the strike-engaging means is aligned with the entry opening, and with the entry opening defining an access passage through which the strike-engaging means must move in order to enter and exit the strike channel; and, (b) the strike channel track surfaces being configured to engage the strike-engaging means and to block withdrawal of the strike-engaging means from the strike channel except when the strike-engaging means is out of alignment with the entry opening.

3. The lock of claim 2 wherein the strike channel track surfaces are inclined in a direction away from the operating unit means to cause the strike-engaging means to move within the strike channel along a path of travel that will cause the relatively movable members to be drawn progressively toward each other in response to force being applied to the operating handle means to move the operating handle means away from its operating position and toward its nested position, whereby the arm means is caused to move away from its released position and toward its clamped position, and the strike-engaging means is caused to move within the strike channel away from a position of alignment with the entry opening.

4. The lock of claim 1 wherein the latch means includes locking means connected to the first frame means for selectively preventing and permitting movement of the movable formation means for selectively enabling the handle means to be moved from its nested position.

5. The lock of claim 1 wherein the strike-engaging means includes roller means that are rotatably carried on the arm means for engaging the strike channel track surfaces when the strike-engaging means is within the strike channel.

6. The lock of claim 5 wherein the strike channel track surfaces are configured to engage and rotate the rollers as the rollers move along the strike channel.

7. The lock of claim 1 wherein:

(a) the track means is pivotally connected to the second frame means, an adjustable stop means is connected to a selected one of the track means and the second frame means for engaging the other of the track means and the second frame means to define a normal relative position of the track means with respect to the second frame means, and biasing means is connected to the track means and to the second frame means for biasing the track means toward said normal position;

(b) biasing means for biasing the second end region toward a position of engagement with the stop means; and, (c) the stop means is adjustable to control the normal position of the track means relative to the second frame means for adjusting the character of the engagement that results between the strike-engaging means and the strike channel track surfaces as the strike-engaging means is moved in the strike channel.

8. A lock for releasably retaining a first and a second relatively movable component together, comprising:

(a) operating unit means including elongate first frame means for mounting on one of the relatively movable components;

(b) strike unit means including second frame means for mounting on the other of the relatively movable components and including strike channel means connected to the second frame means for defining an elongate strike channel bounded by strike channel track surfaces that are defined by portions of the strike channel means including a track means that extent longitudinally along one side of the elongate strike channel;

(c) the operating unit means further including:

(i) operating handle means pivotally connected to the first frame means for movement between projected and nested positions with respect to the first frame means;

(ii) arm means pivotally connected to the first frame means at spaced positions along the first frame means and projecting from the first frame means for movement relative thereto between released and clamped positions;

(iii) operating means for drivingly interconnecting the operating handle means and the arm means for moving the arm means relative to the first frame means between the released and clamped positions in response to movement of the operating handle means relative to the first frame means between the projected and nested positions, respectively; and (iv) the arm means carrying strike-engaging means for being received within the strike channel of the strike unit means when the arm means is positioned in the released position, and for clampingly engaging portions of the strike channel track surfaces when the arm means is in the clamped position.

9. The lock of claim 8 wherein the arm means includes a pair of arm members that are pivotally connected to the elongate first frame means at positions that are longitudinally spaced from each other along the length of the first frame means, and the operating means includes an elongate operating member that extends between and pivotally interconnects with the arm members to drivingly interconnect the arm members for concurrent pivotal movement with respect to the first frame means, and toggle linkage means for drivingly interconnecting the operating handle means and the operating member, the toggle linkage means including lost motion connection means coupling the operating handle means with the toggle linkage means and permitting movement of the operating handle means from a nested position to a projected position wherein the operating handle means can be readily grasped by an operator before further movement of the operating handle means will cause corresponding movement of the toggle linkage means and corresponding movement of the arm members.

10. The lock of claim 9 additionally including means for adjustably mounting the toggle linkage means on the first frame means to selectively position the toggle linkage means with respect to the first frame means to accommodate for installation tolerances and wear.

11. The lock of claim 8 wherein the strike unit means is operable to define a strike channel that is configured to receive the strike-engaging means and to cause the strike-engaging means to move along a path of travel that will cause the strike-engaging means to clampingly engage the strike channel track surfaces so as to cause the relatively movable members to be drawn toward each other in response to force being applied to the operating handle means to move the operating handle means toward its nested position.

12. The lock of claim 8 wherein the strike unit means includes means connected to the second frame means:

(a) for defining an entry opening into the elongate strike channel near one end region of the elongate strike channel, through which entry opening the strike-engaging means must pass in order to enter the strike channel; and, (b) abutment surface means for engaging the strike-engaging means and for blocking movement of the strike-engaging means into the strike channel when the strike-engaging means is brought into engagement with the abutment surface means at a time when the strike-engaging means is not aligned with the entry opening.

13. The lock of claim 8 wherein the strike-engaging means includes roller means that are rotatably carried on the arm means for engaging the strike channel track surfaces when the strike-engaging means is within the strike channel.

14. The lock of claim 8 wherein:

(a) an adjustable stop means is connected to the second frame means;

(b) the track means is of elongate configuration and has first and second end regions, with the first end region being pivotally connected to the second frame means;

(c) biasing means is provided for biasing the second end region toward a normal position of engagement with stop means; and, (d) the stop means is adjustable to control the normal position of the track means relative to the second frame means for adjusting the character of the engagement that results between the strike-engaging means and the strike channel track surfaces as the strike-engaging means is moved in the strike channel.

* * * * *